US005704994A

United States Patent [19]

Kuwabara et al.

[11] Patent Number: 5,704,994

[45] Date of Patent: Jan. 6, 1998

[54] METHOD OF CASE-HARDENING SHAPED OBJECT

[75] Inventors: Mitsuo Kuwabara; Mitsuhiro Funaki; Kazuhito Hiraga; Tetsuya Ohishi, all of Sayama, Japan

[73] Assignee: Honda Giken Kogyo Kabushiki Kaisha, Tokyo, Japan

[21] Appl. No.: 549,187

[22] Filed: Oct. 27, 1995

[30] Foreign Application Priority Data

Oct. 27, 1994 [JP] Japan ..... 6-264112
Nov. 14, 1994 [JP] Japan ..... 6-279069

[51] Int. Cl.[6] ..... C23C 14/00

[52] U.S. Cl. ..... 148/217; 427/226; 427/399

[58] Field of Search ..... 148/217, 316, 148/237; 427/226, 399

[56] References Cited

U.S. PATENT DOCUMENTS 2,693,431 11/1954 Williams ..... 148/237
4,066,821 1/1978 Cook ..... 427/399
5,415,704 5/1995 Davidson ..... 148/316

FOREIGN PATENT DOCUMENTS 63-26346 2/1988 Japan .

*Primary Examiner*—Sam Silverberg

*Attorney, Agent, or Firm*—Birch, Stewart, Kolasch & Birch, LLP

[57] ABSTRACT

A shaped object with a roughened surface is immersed in an aqueous solution of a metal salt and/or a solution of an organic metal. After the shaped object is dried, it is heated to form a metal-diffused layer in the shaped object and a ceramic surface layer on the shaped object. The ceramic surface layer has a large hardness, and is prevented from peeling off.

12 Claims, 8 Drawing Sheets

METHOD OF CASE-HARDENING SHAPED OBJECT

BACKGROUND OF THE INVENTION

1. Field of the Invention

The present invention relates to a method of case-hardening a shaped object by forming a ceramic layer on the surface of the shaped object and a metal-diffused layer inwardly of the ceramic layer.

2. Description of the Related Art

Dies, jigs, cutters including carbide or cermet throw-away tips, drill bits, reamers, etc., and other shaped objects for use in sliding regions such as of shafts are case-hardened by a diffusion heat treatment such as carburizing, nitriding, or the like, or a coating process such as physical vapor deposition (PVD) or chemical vapor deposition (CVD) in order to maintain desired levels of wear resistance.

The diffusion heat treatment such as carburizing, nitriding, or the like is simpler and less expensive than the coating process such as PVD or CVD. However, the diffusion heat treatment remains to be improved because it fails to provide a sufficient level of wear resistance and durability with respect to certain shaped objects that are case-hardened by the diffusion heat treatment.

The coating process such as PVD or CVD is more costly than the carburizing, nitriding, or similar processes. Furthermore, when a layer coated by the coating process, such as a coated layer on a cutter, has a thickness in the range of from few to 30 μm, the surface of the coated layer tends to peel off the surface of the base metal.

Japanese patent publication No. 4-24424 discloses the provision of a composite layer on the surface of a base metal, the composite layer comprising a coated layer produced by an arc-evaporated ion plating process and a coated layer produced by a fusion-evaporated ion plating process. However, the disclosed case-hardening technique suffers drawbacks in that it poses limitations on the use and size of shaped objects that can be processed, necessarily results in an increase in the cost, requires a highly sophisticated level of technology for its implementation, and is carried out in complex operation.

SUMMARY OF THE INVENTION

It is a principal object of the present invention to provide an inexpensive and simple method of case-hardening a shaped object to produce a surface layer which is of excellent hardness and is prevented from being peeled off, on the shaped object.

According to the present invention, the surface of a shaped object is roughened, and then a metal salt and/or an organic metal is applied to the shaped object. After the shaped object is dried, it is heated. When the shaped object is heated, the metal salt and/or the organic metal reacts with the shaped object, and diffused into the shaped object. Therefore, a metal-diffused layer is formed in the shaped object due to alloying and microscopic deposition, and the surface layer of the shaped object is converted into a ceramic layer by nitriding, carburizing, carbonitriding, or oxidizing. Therefore, the wear resistance, sliding capability, and heat resistance of the surface layer of the shaped object can be increased, and the strength of the internal structure of the shaped object can be increased for preventing the surface layer from peeling off.

The surface of the shaped object may be roughened by an etching process using an acid or alkaline solution. If the metal salt used is highly acid, then the surface of the shaped object is not roughened, but can be etched when the metal salt is applied thereto. Instead of etching the surface of the shaped object with an acid or alkaline solution, the surface of the shaped object may be machined to a rough finish, and then the metal salt may be applied to the surface of the shaped object.

In the case where the shaped object is made of carbide, if the shaped object has been machined to a mirror finish, then it is etched with nitric acid, aqua regia, or the like. If the shaped object has been machined to a rough finish having a surface roughness of 0.8 s or below, then it is not etched, but is directly immersed in the aqueous solution of a metal salt. After the shaped object is dried, it is heated to a temperature at which the metal is sufficiently diffused into the shaped object, and maintained at the temperature for a predetermined period of time. If the metal of the metal salt is capable of reacting with the main component, WC, of carbide as well as the coupling layer metal, Co, thereof, then the hardness as well as the strength of the shaped object can be increased.

Materials such as tool steel or die steel which will be annealed due to property changes when heated twice should preferably be immersed in a metal salt or an organic metal before being heated.

When the shaped object which has been etched is immersed in an aqueous solution of a metal salt and/or a solution of an organic metal to apply the metal salt and/or the organic metal to the shaped object, a binder which will not deteriorate the properties of the shaped object may be added to the aqueous solution of a metal salt or the solution of an organic metal. The binder may comprise a small amount of an emulsion of acrylic resin, a water-soluble phenolic resin, methyl cellulose, starch, or the like if the shaped object is immersed in the aqueous solution of a metal salt, or nitrocellulose or vinyl acetate if the shaped object is immersed in the solution of an organic metal.

The above and other objects, features, and advantages of the present invention will become more apparent from the following description when taken in conjunction with the accompanying drawings in which preferred embodiments of the present invention are shown by way of example.

DETAILED DESCRIPTION OF THE PREFERRED EMBODIMENTS

Figure 1:
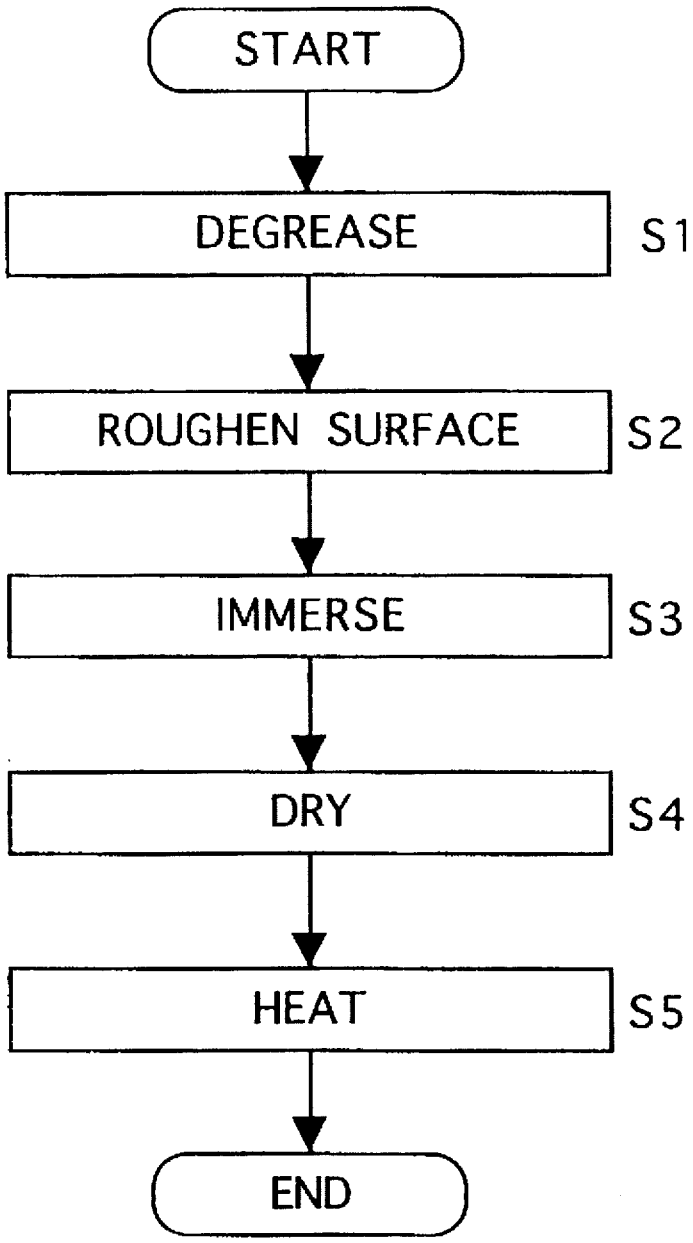
FIG. 1 is a flowchart of an operation sequence of a method of case-hardening a shaped object according to a first embodiment of the present invention.

FIG. 1 shows an operation sequence of a method of case-hardening a shaped object according to a first embodiment of the present invention. The method of case-hardening a shaped object according to the first embodiment will be described below with reference to FIG. 1.

First, a blank of carbide, cermet, SKD, SKH, SCM, or SNCM according to JIS (Japanese Industrial Standards) is prepared as shaped objects, and degreased by an alkaline solution in a step S1. The degreased blank is etched by an acid solution to produce surface roughness or irregularities thereon in a step S2. If the degreased blank already has a large degree of surface roughness, then it is not necessary to etch the degreased blank for added surface roughness.

Thereafter, the blank is immersed in an aqueous solution of a metal salt and/or a solution of an organic metal in a step S3. The aqueous solution of a metal salt may comprise an aqueous solution of a nitrate, acetate, chloride, etc. of nickel (Ni), chromium (Cr), molybdenum (Mo), vanadium (V), tungsten (W), zirconium (Zr), cobalt (Co), manganese (Mn), cerium (Ce), or samarium (Sm). The solution of an organic metal may comprise a mixture of aluminum (Al), yttrium (Y), either one of lanthanoids, silicon (Si), titanium (Ti), zirconium (Zr), hafnium (Hf), vanadium (V), tantalum (Ta), niobium (Nb), chromium (Cr), molybdenum (Mo), or tungsten (W) and an organic salt such as an ethoxide, a propoxide, a butoxide, an imide, an amide, or the like. While the aqueous solution of a metal salt may comprise an aqueous solution of sulfate, the aqueous solution of sulfate is not suitable for use because the surface of the blank immersed therein turns black.

The immersed blank is then dried in a step S4. After the solvent is removed from the blank, the blank is heated in a step S5. In the step S5, the metal salt and/or the organic metal is diffused into the base metal of the blank by thermal diffusion or reactive diffusion, forming a metal-diffused layer in the blank. The surface layer of the blank is nitrided, carburized, carbonitrided, or oxidized into a ceramic layer by an atmospheric gas, decomposed substances, etc. The case-hardening process of the blank is now finished. The case-hardened blank is thereafter machined or processed into a final product.

<EXAMPLE 1>

Commercially available carbide tips (equivalent to JIS-K-10 material) and cermet tips were selected as base members (shaped objects). Each of the carbide tips and the cermet tips was in the shape of a hole-free square with an inscribed circle having a diameter of 12.7 mm, and had a thickness of 4.76 mm. A predetermined number of carbide tips and cermet tips were sufficiently degreased by an aqueous solution of 5% of NaOH, immersed in an aqueous solution of 30% of nitric acid, and etched to a depth of about 5 μm on their surfaces.

The etched carbide tips were immersed in an aqueous solution of 10% of nickel nitrate, an aqueous solution of 20% of nickel nitrate, an aqueous solution of 30% of nickel nitrate, and a saturated aqueous solution of nickel nitrate. The etched cermet tips were immersed in an aqueous solution of 10% of cobalt nitrate, an aqueous solution of 20% of cobalt nitrate, an aqueous solution of 30% of cobalt nitrate, and a saturate aqueous solution of cobalt nitrate. To the aqueous solutions of cobalt nitrate, there was added a small amount of an emulsion of acrylic resin for uniformizing coated layers.

Then, the carbide tips and the cermet tips were dried, and thereafter heated at 1360° C. for 30 minutes. The heated carbide and cermet tips were inspected for changes in their properties, specifically changes in their hardness. The changes in the hardness of the carbide tips and the cermet tips are given in Table 1 below.

TABLE 1

| | Untreated product (Conventional) | 10 | 20 | 30 | Saturated solution |
|---|---|---|---|---|---|
| | | Concentration of aq. sol. of nickel nitrate (%) | | | |
| Carbide: hardness $H_{RA}$ | 91.5 | 92.5 | 93.4 | 93.8 | 93.7 |
| | | Concentration of aq. sol. of cobalt nitrate (%) | | | |
| Cermet: hardness $H_{RA}$ | 91.5 | 92.3 | 93.1 | 93.5 | 93.7 |

It was confirmed that the hardnesses of the carbide tips and the cermet tips increased from the hardness of the conventional untreated product after they were immersed in any of the aqueous solutions. Since the measured hardnesses varied in a range of about 0.5%, they were definitely higher than the hardness of the conventional untreated product.

The carbide tips immersed in the aqueous solutions of nickel nitrate were heated at 1360° C. for different times, and then inspected for the relationship between the heating times and their hardnesses. Table 2 given below shows the measured relationship between the heating times and their hardnesses. It can be seen from Table 2 that the hardness increases as the heating time increases. It was found that as the heating time increased, the dependency on the concentrations of nickel nitrate decreased because the grain growth of nickel contributed to the increase of the hardness.

TABLE 2

| Heating time (min.) | Untreated product (Conventional) | Concentration of aq. sol. of nickel nitrate (%) 10 | 20 | 30 | solution |
|---|---|---|---|---|---|
| 30 | 91.5 ($H_{RA}$) | 92.5 ($H_{RA}$) | 93.4 ($H_{RA}$) | 93.8 ($H_{RA}$) | 93.7 ($H_{RA}$) |
| 45 | 91.5 | 92.8 | 94.6 | 94.8 | 95.2 |
| 60 | 91.5 | 93.6 | 95.4 | 95.7 | 95.4 |
| 90 | 91.5 | 94.3 | 95.8 | 96.1 | 95.9 |
| 150 | 91.5 | 95.2 | 96.2 | 96.4 | 96.1 |

<EXAMPLE 2>

Commercially available carbide tips (equivalent to JIS-K-10 material) were used as base members (shaped objects), and degreased and etched in the same manner as with Example 1 above. The carbide tips were then immersed in aqueous solutions of metal salt in Experimental Examples 1~10 in Table 3 given below, solutions of organic metal in Experimental Examples 11~31 in Table 4 given below, and mixtures of aqueous solutions of metal salt and solutions of organic metal in Experimental Examples 32~35 in Table 5 given below.

The carbide tips were then heated at 1380° C. for 60 minutes in a nitrogen atmosphere under 1 bar, and thereafter inspected for property changes, specifically, changes in the hardness due to ceramic surface layers formed on the carbide tips.

TABLE 3

| Aqueous solution of metal salt | | Hardness ($H_{RA}$) | | | |
|---|---|---|---|---|---|
| Exp. Examples | Solution | 10 | 20 | 30 | Saturated solution |
| | | Concentration (%) | | | |
| 1 | chromium nitrate | 91.6 | 92.5 | 93.4 | 93.5 |
| 2 | molybdenum nitrate | 92.1 | 92.4 | 93.1 | 93.4 |
| 3 | tungsten nitrate | 91.8 | 92.8 | 93.6 | 93.4 |
| 4 | vanadium nitrate | 92.2 | 93.2 | 93.6 | 93.6 |
| 5 | manganese chloride | 91.8 | 92.8 | 9.34 | 93.8 |
| 6 | zirconium nitrate | 91.9 | 92.2 | 93.4 | 93.2 |
| 7 | cerium nitrate | 91.6 | 91.9 | 92.4 | 92.7 |
| 8 | samarium nitrate | 92.8 | 93.6 | 94.2 | 95.1 |
| 9 | nickel acetate | 93.6 | 93.8 | 94.2 | 94.5 |
| 10 | manganese acetate | 92.1 | 92.6 | 93.1 | 93.4 |

TABLE 4

| Solution of organic metal | | Hardness ($H_{RA}$) | | | |
|---|---|---|---|---|---|
| Exp. Examples | Solutions | Concentration (%) | | | |
| | | 10 | 20 | 30 | 100 |
| 11 | aluminum isopropoxide | 91.7 | 92.1 | 92.7 | 93.4 |
| 12 | titanium isopropoxide | 92.1 | 92.4 | 92.6 | 93.8 |
| 13 | zirconium isopropoxide | 91.7 | 92.1 | 92.6 | 93.2 |
| 14 | vanadium isopropoxide | 92.4 | 93.6 | 93.8 | 94.1 |
| 15 | chromium isopropoxide | 91.9 | 92.3 | 92.5 | 93.2 |
| 16 | molybdenum isopropoxide | 91.8 | 92.2 | 92.4 | 92.8 |
| 17 | samarium isopropoxide | 92.6 | 93.4 | 93.7 | 94.6 |
| 18 | silicon ethoxide | 92.1 | 92.3 | 92.6 | 93.1 |
| 19 | silicon imide | 93.1 | 93.4 | 93.2 | 93.2 |
| 20 | hafnium imide | 92.6 | 92.9 | 93.3 | 94.5 |
| 21 | zirconium imide | 92.4 | 92.8 | 93.1 | 94.3 |
| 22 | aluminum imide | 92.2 | 92.7 | 93.9 | 94.8 |
| 23 | yttrium imide | 92.2 | 92.4 | 92.8 | 93.2 |
| 24 | titanium imide | 93.2 | 93.6 | 94.1 | 95.2 |
| 25 | titanium butoxide | 92.8 | 93.2 | 93.4 | 95.4 |
| 26 | tungsten imide | 92.1 | 92.7 | 92.8 | 93.1 |
| 27 | samarium imide | 93.2 | 93.8 | 94.6 | 96.8 |
| 28 | tantalum imide | 92.2 | 92.4 | 92.7 | 93.1 |
| 29 | chromium amide | 92.5 | 92.6 | 93.8 | 94.2 |
| 30 | chromium butoxide | 92.4 | 92.7 | 93.8 | 94.6 |
| 31 | aluminum isopropoxide + titanium iso propoxide | 93.4 | 95.2 | 96.8 | 97.6 |

TABLE 5

| Aqueous solution of metal salt + solution of organic metal | | Hardness ($H_{RA}$) | | | |
|---|---|---|---|---|---|
| Exp. Examples | Solutions | 10 | 20 | 30 | 100 |
| | | Concentration (%) | | | |
| 32 | nickel nitrate + titanium isopropoxide | 94.2 | 95.8 | 98.2 | 98.4 |
| 33 | nickel nitrate + aluminum isopropoxide | 93.2 | 94.3 | 95.2 | 95.6 |
| 34 | chromium nitrate + titanium isopropoxide | 93.6 | 94.9 | 96.2 | 96.5 |
| 35 | nickel nitrate + titanium isopropoxide + aluminum | 94.3 | 95.2 | 96.8 | 97.8 |

The results in Tables 3, 4, and 5 show that the surface layers of the carbide tips were converted into ceramic layers and became harder than those of conventional products. It is therefore possible to produce ceramic surface layers on shaped objects such as carbide tips in a manner more inexpensive and simpler than the conventional processes of PVD and CVD. Since the metal layers are diffused within the shaped objects, the ceramic surface layers are prevented from peeling off.

<EXAMPLE 3>

Plates of a commercially available carbide material (equivalent to JIS-K-10 material) were prepared as base members (shaped objects) having dimensions 8×3×60 mm and a surface roughness of 0.8 s. The plates were degreased by an aqueous solution of alkali, i.e., an aqueous solution of 10% of NaOH, and then etched by an aqueous solution of 30% of $NHO_3$. The etched plates were immersed in an aqueous solution of 30% of nickel nitrate and solutions each composed of aluminum isopropoxide and titanium isopropoxide mixed at a ratio of 30:70. The mixed solutions of isopropoxides had respective concentrations of 30%, 50%, 70%, and 100%. After the plates were dried, they were heated at 1380° C. for 60 minutes in a nitrogen atmosphere under 1 bar. Each of the heated plates was examined for three-point bending strength (MPa), hardness ($H_{RA}$), and ceramic layer thickness (μm). The results are given in Table 6 below.

TABLE 6

| | Aluminum isopropoxide + titanium isopropoxide | | | | |
|---|---|---|---|---|---|
| | 30% | 50% | 70% | 100% | JIS-K-10 |
| 3-point bending strength (MPa) | 2380 | 2460 | 2540 | 2700 | 1000 |
| Hardness ($H_{RA}$) | 97.4 | 98.2 | 98.5 | 98.6 | 91.5 |
| Ceramic layer thickness (μm) | 12 | 23 | 27 | 38 | — |

The results shown in Table 6 indicate that when the plates were immersed in the aqueous solution of nickel nitrate and the mixed solutions of aluminum isopropoxide and titanium isopropoxide, their three-point bending strength and hardness were much higher than those of conventional untreated products. It was also found out that the ceramic layers could be formed to various thicknesses depending on the concentrations of the isopropoxides in the solutions.

Figure 2:
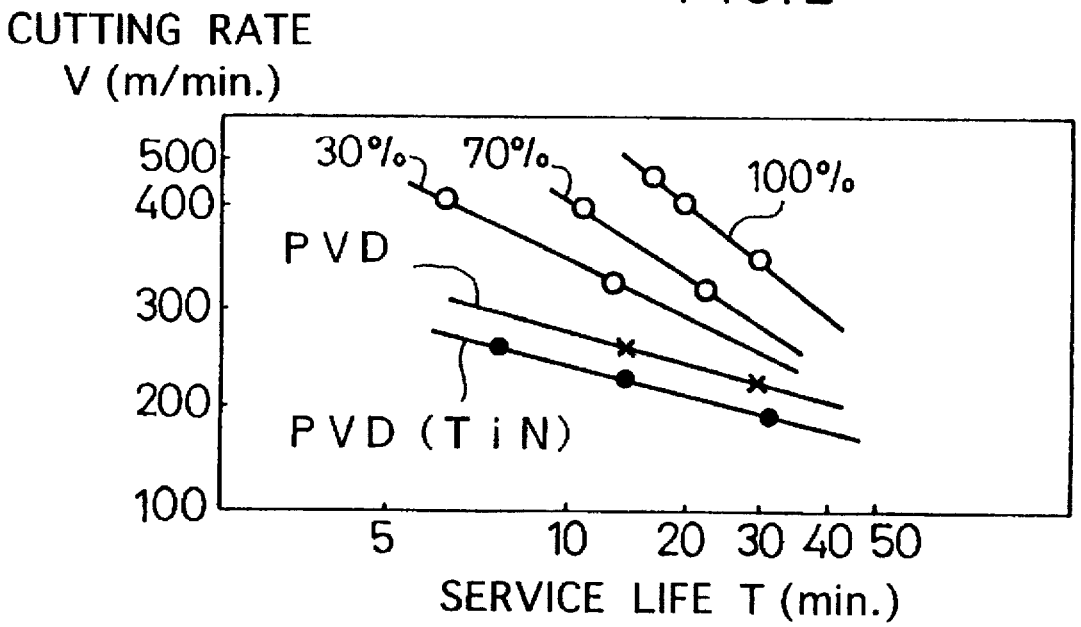
FIG. 2 is a diagram showing the relationship between the service life T and the cutting rate V of carbide tips.

An actual cutting test was conducted on commercially available PVD-coated tips and carbide tips immersed in mixed solutions of isopropoxides at different concentrations. A workpiece to be cut was made of steel SCM 435. The relationship between the service life T and the cutting rate V of each of the tips is shown in FIG. 2. A review of FIG. 2 indicates that the carbide tips treated by immersion in the mixed solutions of isopropoxides had wear resistance much higher than the commercially available PVD-coated tips.

Figure 3:
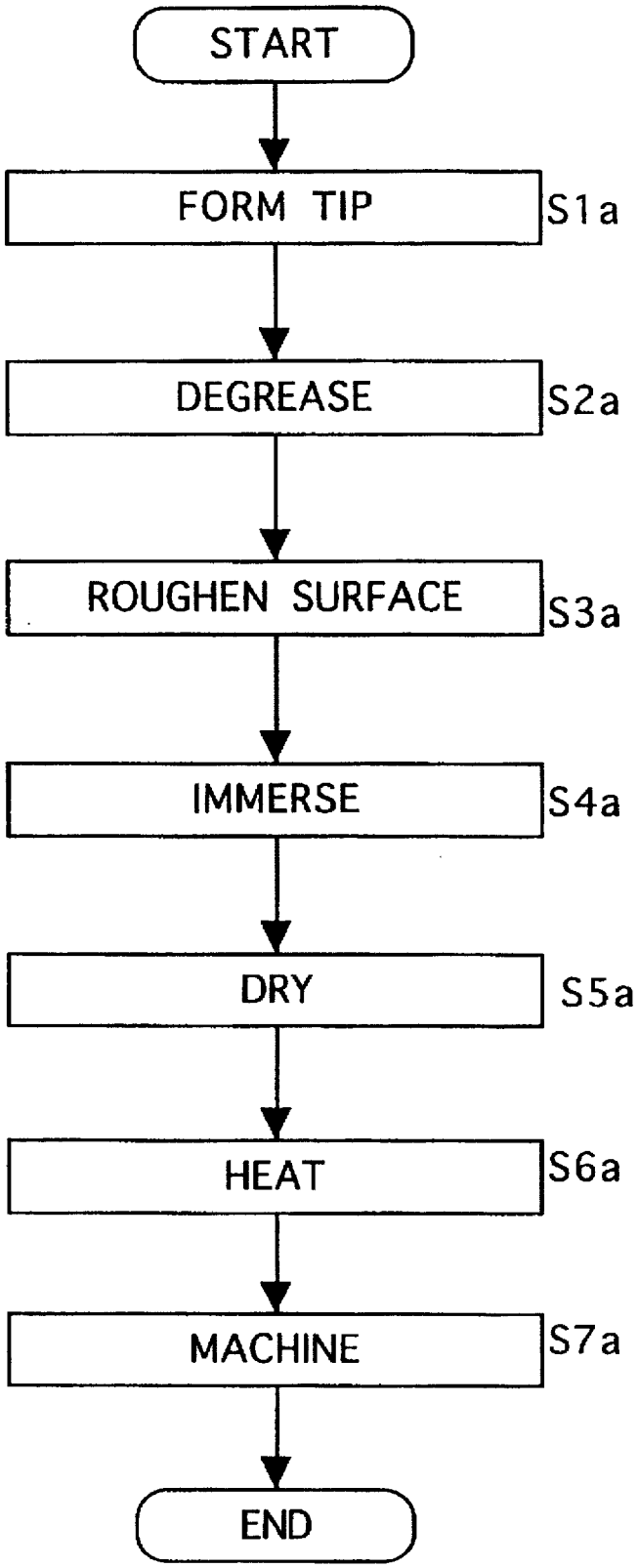
FIG. 3 is a flowchart of an operation sequence of a method of case-hardening a shaped object according to a second embodiment of the present invention.

FIG. 3 shows an operation sequence of a method of case-hardening a shaped object according to a second embodiment of the present invention. The method of case-hardening a shaped object according to the second embodiment will be described below with reference to FIG. 3.

First, a cutter blank with a tip of carbide or cermet is prepared in a step S1*a*. Any cutting oil or the like which may have been deposited on the surface of the tip when the tip was machined tends to make irregular the application of a grain growth accelerator or a ceramic layer forming material. Therefore, the cutter blank is degreased by an alkaline solution to remove such a cutting oil or the like in a step S2*a*. The degreased tip is then etched by an acid solution to produce surface roughness or irregularities thereon in a step S3*a*. The surface roughness is produced in order to allow a grain growth accelerator and a ceramic layer forming material to be applied well to the surface of the tip.

The tip is then immersed in a grain growth accelerator and a ceramic layer forming material in a step S4*a*, whereupon a layer is formed on the surface of the tip. At this time, a thickening agent, a binder, or the like may be added to allow the grain growth accelerator and the ceramic layer forming material to be applied better to the surface of the tip.

Then, the blank is dried in a step S5*a*, removing the solvent therefrom. Thereafter, the blank is heated in a step S6*a*. In the step S6*a*, a metal salt and/or an organic metal is diffused into the base metal (tip) of the blank by thermal diffusion or reactive diffusion, forming a metal-diffused layer in the blank. The surface layer of the blank is nitrided, carburized, carbonitrided, or oxidized into a ceramic layer by an atmospheric gas, decomposed substances, etc. The case-hardening process of the tip is now finished. The case-hardened tip is thereafter machined or processed into a final product such as a tip, a drill bit, a reamer, or the like in a step S7*a*.

<EXAMPLE 4>

Commercially available carbide tips (equivalent to JIS-K-10 material) were selected as cutter blanks. Each of the carbide tips was in the shape of a square with an inscribed circle having a diameter of 12.7 mm, and had a thickness of 4.76 mm. A predetermined number of carbide tips were sufficiently degreased by an aqueous solution of 20% of NaOH, immersed in an aqueous solution of 25% of hydrochloric acid, and etched on their surfaces.

The carbide tips were immersed in aqueous solutions A~F of metal salt shown in Table 7 given below, and dried. Thereafter, the carbide tips were selectively immersed in solutions a~g of metal salt shown in Table 8 given below. Combinations of those immersing solutions are shown in Experimental Examples 42~64 in Table 9 given below.

Each of the carbide tips selectively immersed in the solutions a~g of metal salt was dried in a drier at 80° C. for 12 hours, and then heated. Specifically in the heating process, each of the carbide tips was kept at 450° C. for 15 minutes and 650° C. for 30 minutes, then at 1240° C. for 10 minutes, and at 1320° C. at 15 minutes. In the heating process thus far, the temperature increased at a rate of 10° C./minute, and each of the carbide tips was fired (heated) in a vacuum environment.

Thereafter, the temperature increased at a rate of 10° C./minute up to 1360° C., and each of the carbide tips was kept at 1360° C. for 30 minutes. Then, the temperature increased at a rate of 5° C./minute up to 1380° C., and each of the carbide tips was kept at 1380° C. for 90 minutes. Below 1320° C., each of the carbide tips was kept in a nitrogen atmosphere under a pressure ranging from 3 to 5 Torr. At temperatures higher than 1320° C., each of the carbide tips was kept in a nitrogen atmosphere under a pressure of 1 bar. After being held at 1380° C., each of the carbide tips was quenched to 1000° C., kept at 1000° C. for 60 minutes, and thereafter quenched to room temperature. While each of the carbide tips was being quenched, it was held in a nitrogen gas under a pressure of 3.5 bar.

TABLE 7

| | Type of metal salt | Concentration of metal salt |
|---|---|---|
| A | nickel nitrate | 25% |
| B | nickel acetate | 20% |
| C | chromium nitrate | 15% |
| D | manganese acetate | 15% |
| E | iron (II) chloride | 20% |
| F | tungsten nitrate | 10% |

TABLE 8

| | Type of organic salt | Concentration of organic salt |
|---|---|---|
| g | aluminum isopropoxide | 60% |
| h | titanium isopropoxide | 40% |
| i | zirconium isopropoxide | 50% |
| j | titanium ethoxide | 30% |
| k | zirconium butoxide | 60% |
| l | aluminum imide | 50% |
| m | chromium imide | 80% |
| n | vanadium isopropoxide | 60% |
| o | chromium amide | 40% |

TABLE 9

| Exp. Ex. | Combinations of immersing sol. | Measured hardness (Hv) Surface | 0.1 mm | 0.2 mm |
|---|---|---|---|---|
| 41 | Com. Example | 1620 | 1620 | 1620 |
| 42 | 25A . . . $Ni(NO_3)_2$ | 2310 | 2180 | 2050 |
| 43 | 15C . . . $Cr(NO_3)_3$ | 2230 | 2040 | 1850 |
| 44 | 15D . . . $MnNO_3$ | 1920 | 1840 | 1810 |
| 45 | 20E . . . $FeCl_3$ | 1930 | 1820 | 1760 |
| 46 | A → g + h | 2460 | 2250 | 2100 |
| 47 | C → g + h | 2350 | 2150 | 1940 |
| 48 | D → g + h | 2020 | 1910 | 1850 |
| 49 | E → g + h | 2000 | 1860 | 1800 |
| 50 | A → i | 2420 | 2210 | 2050 |
| 51 | A → g + j | 2450 | 2230 | 2080 |
| 52 | C → j | 2310 | 2150 | 1980 |
| 53 | A → l + m | 2380 | 2200 | 2050 |
| 54 | A → n | 2350 | 2150 | 2040 |
| 55 | A → m | 2400 | 2250 | 2050 |
| 56 | F | 1870 | 1760 | 1690 |
| 57 | B | 2180 | 1970 | 1780 |
| 58 | B → k | 2300 | 2190 | 2050 |

TABLE 9-continued

| Exp. Ex. | Combinations of immersing sol. | Measured hardness (Hv) Surface | 0.1 mm | 0.2 mm |
|---|---|---|---|---|
| 59 | A → o | 2360 | 2210 | 2080 |
| 60 | B → o | 2310 | 2200 | 2070 |
| 61 | D → m | 1990 | 1870 | 1840 |
| 62 | E → m | 1980 | 1860 | 1800 |
| 63 | D → m + g + h | 2270 | 2020 | 1890 |
| 64 | A → o + g + h | 2480 | 2190 | 2110 |

The carbide tips were measured for their hardnesses as shown in Table 9. The hardnesses were measured as micro-Vickers hardnesses under a load of 1 kgf. A produce having the same composition and heated at the same temperature as the above carbide tips was produced as a comparative example (see Experimental Example 41).

According to Example 4, the hardnesses of Experimental Examples 42~46 varied in a gradient fashion, and were much higher than the hardness of the comparative example (Experimental Example 41).

<EXAMPLE 5>

Commercially available carbide tips (equivalent to JIS-K-10 and JIS-P-10 materials) were selected as cutter blanks. Each of the carbide tips was in the shape of a square with an inscribed circle having a diameter of 12.7 mm, and had a thickness of 4.76 mm. A predetermined number of carbide tips were sufficiently degreased by an aqueous solution of 20% of NaOH, immersed in an aqueous solution of 25% of hydrochloric acid, and etched on their surfaces.

Some of the carbide tips were immersed in an aqueous solution of 25% of nickel nitride and an solution of aluminum isopropoxide and titanium isopropoxide mixed at a ratio of 30:70, and the others were immersed in an aqueous solution of 25% of nickel nitride and solutions of zirconium imide and chromium amide each having a concentration of 70%. The carbide tips were then dried and fired (heated) under the same conditions as those in Example 4.

These carbide tips, the carbide tips according to Example 4, a commercially available product corresponding to the JIS-P-10 material, commercially available products of cermet, and commercially available products treated by PVD and CVD were examined for thicknesses of hard ceramic layers formed on their surfaces, gradient composition widths as determined by EPMA, and tip surface harnesses $H_{RA}$. The measured values are given in Table 10 below. The commercially available products of cermet were treated in the same manner as the carbide tips except that cobalt nitrate was used instead of nickel nitrate, and their measured values are also given in Table 10.

TABLE 10

| Exp. Ex. | Types of tested materials | Ceramic layer thickness (μm) | Diffused distance (μm) | Surface hardness ($H_{RA}$) |
|---|---|---|---|---|
| 71 | *Product corresponding to JIS-P-10 (untreated) | — | — | 91.8 |
| 72 | *Cermet (untreated) | — | — | 91.8 |
| 73 | JIS-P-10 treated by nickel nitrate, aluminum titanium isopropoxide | 10 | 400 | 98.2 |
| 74 | JIS-P-10 treated by nickel nitrate, zirconium imide, and chrominum amide | 8 | 300 | 97.6 |
| 75 | JIS-K-10 treated by nickel nitrate, aluminum + titanium iropropoxide | 12 | 600 | 98.1 |
| 76 | JIS-K-10 treated by nickel nitrate, zirconium imide, and chrominum amide | 10 | 500 | 97.5 |
| 77 | Cermet treated by cobalt nitrate, aluminum + titanium iropropoxides | 10 | 400 | 97.6 |
| 78 | Cermet treated by cobalt nitrate, zirconium imide, and chrominum amide | 8 | 300 | 96.6 |
| 79 | *JIS-P-10 treated by PVD (TiN, TiCN, alumina 5 layers) | 6 | 1 | 89.1 |
| 80 | *JIS-P-10 treated by CVD (TiN, TiCN, alumina 12 layers) | 6 | 2 | 89.2 |
| 81 | A → g + h (Exp. Ex. 6) | 12 | 1800 | 98.2 |

*Commercially available.

Figure 4:
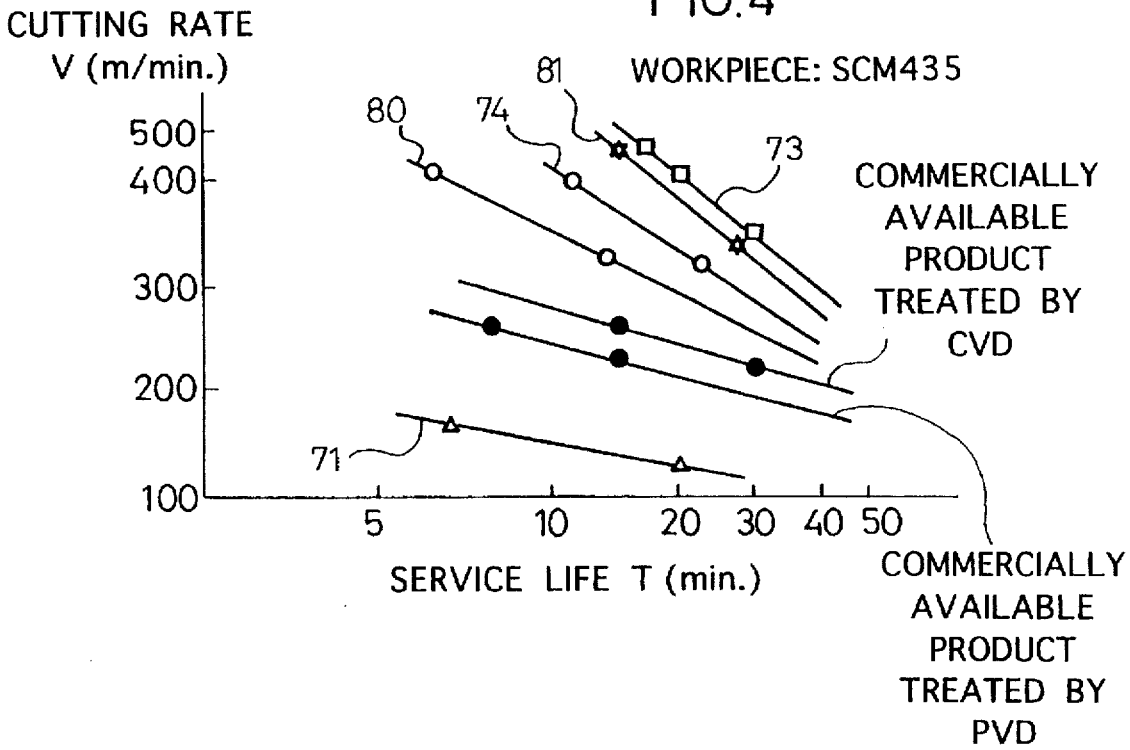
FIG. 4 is a diagram of service life curves of tips when they cut a workpiece of steel.
Figure 5:
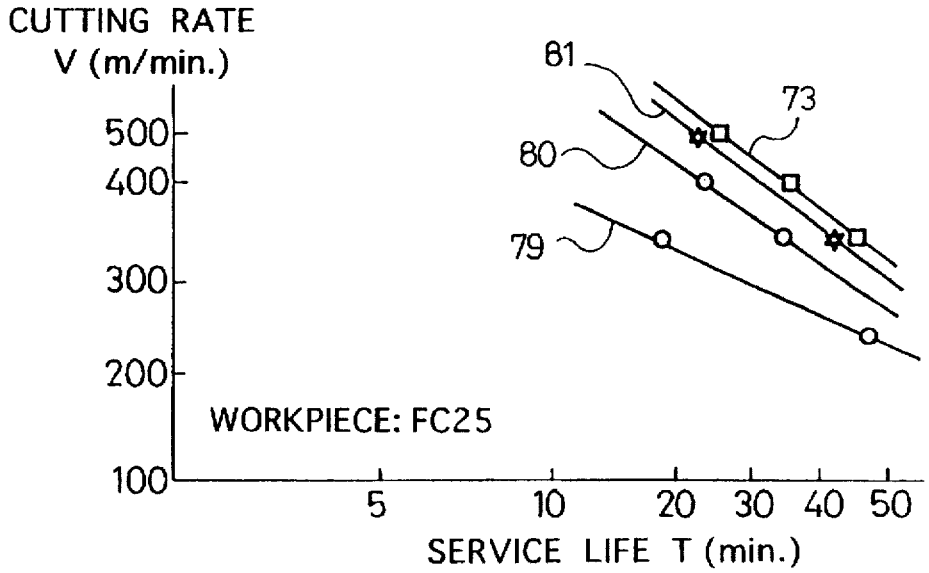
FIG. 5 is a diagram of service life curves of tips when they cut a workpiece of cast iron.
Figure 6:
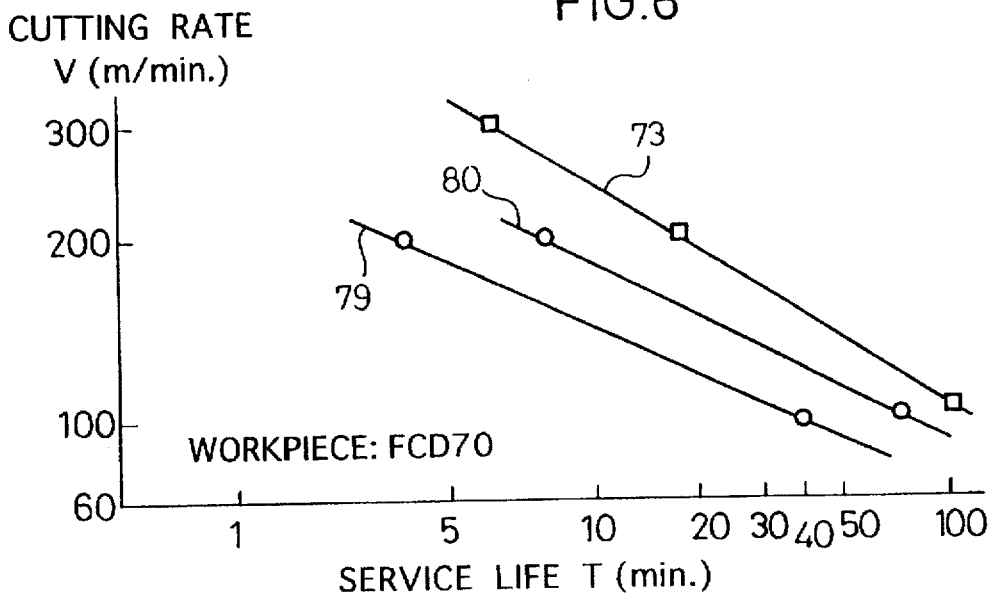
FIG. 6 is a diagram of service life curves of tips when they cut a workpiece of ductile cast iron.
Figure 7:
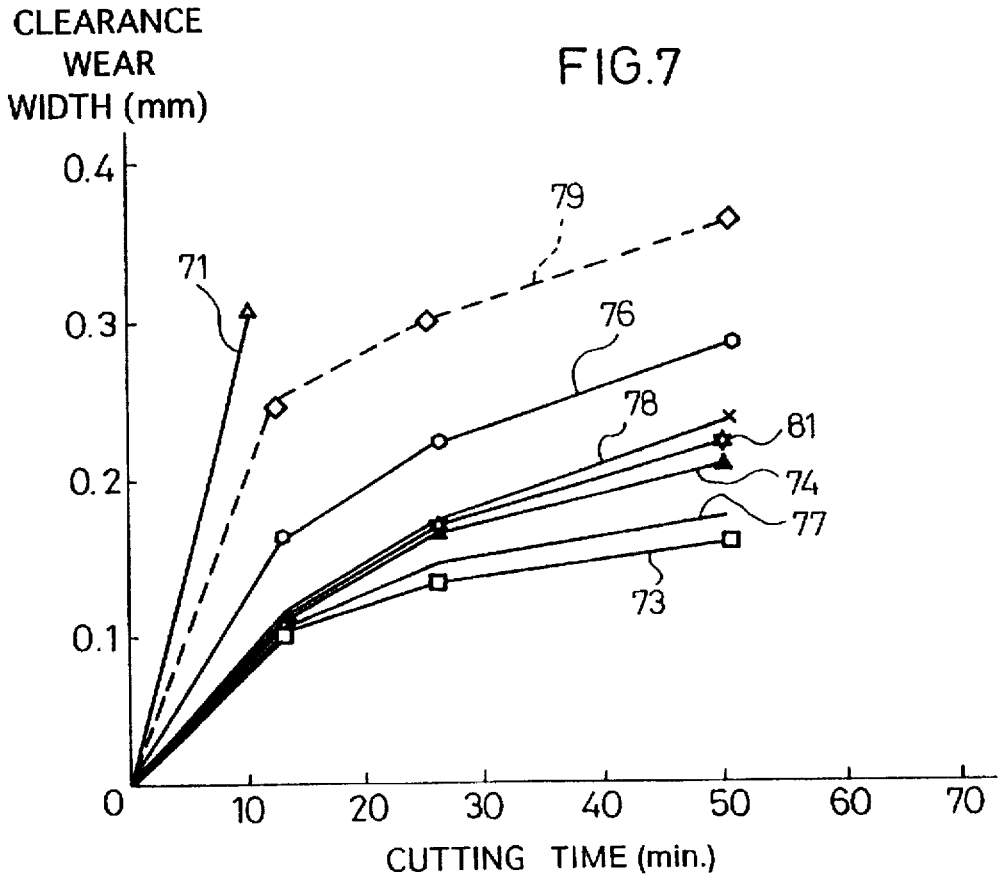
FIG. 7 is a diagram of the wear resistance of tips.

FIGS. 4 through 6 show the results of a life test conducted as an actual performance test, and FIG. 7 shows the results of a wear-resistance test. It can be seen from FIGS. 4 through 7, that Examples 4 and 5 had values much better than those of the commercially available product corresponding to the JIS-P-10 material, and exhibited better performance than the commercially available products treated by PVD and CVD.

It was recognized that all the properties of Examples 5 and 6 improved. This is because the hard ceramic layer produced on the surface was tough, indicating a hardness estimated to be close to the hardness of actual ceramic materials. While the hardness would be small if the produced ceramic layer were porous, the produced ceramic layer is assumed to be dense from the obtained values.

Since Examples 4 and 5 had a component diffused layer which is largely involved in the adhesion and durability of the surface layer, they actually had a gradient function for reliably preventing the surface layer from peeling off. Furthermore, no special equipment was needed to produce Examples 4 and 5, and any process of cleaning the interior of the chamber each time layer structures are changed for the production of Examples 4 and 5, unlike the production of multilayer coatings. Consequently, it is possible to produce cutter tips of carbide and cermet which are inexpensive and high in performance.

<EXAMPLE 6>

56 weight % of a powder of WC having an average diameter of 2 μm, 30 weight % of a powder of TiC having an average diameter of 1.5 μm, 5 weight % of a powder of Ti having an average diameter of 1.2 μm, 3 weight % of a powder of TaC having an average diameter of 1.5 μm, and 6 weight % of a metal powder of Co having an average diameter of 0.8 μm were sufficiently mixed by a wet mixing process. The mixture was then molded under pressure by a wet molding process, producing a molded body having a diameter of 12.5 mm and a length of 100 mm.

In order to remove a solvent of alcohol used and 0.1% of ammonium stearate added as a friction reducer in the molding process, the molded body was maintained at 250° C., 350° C., 450° C., and 650° C. for 10 minutes, 10 minutes, 15 minutes, and 30 minutes, respectively, under a reduced pressure ranging from 3 to 5 Torr in a nitrogen gas while nitrogen is flowing, and then maintained at 1000° C. for 30 minutes. The molded body thus heated was thus fired into a preliminary sintered body. Thereafter, the preliminary sintered body was fired in a main firing process in which the temperature increased at a rate of 10° C./minute. Specifically, the preliminary sintered body was maintained at 650° C. for 45 minutes, then maintained at 1250° C. for 15 minutes, 1320° C. for 30 minutes, 1360° C. for 30 minutes, and 1380° C. for 60 minutes. The preliminary sintered body was fired in vacuum up to 1320° C., and under a pressure of 1 bar in a nitrogen gas beyond 1320° C.

The finally sintered body was machined into the shapes of a drill bit and a reamer, which were provided with tips. A drill bit and a reamer as cutters were thus produced.

The drill bit and the reamer, and a commercially available drill bit material of the P type according to JIS were sufficiently degreased by an aqueous solution of 20% of NaOH, and then immersed in an aqueous solution of 25% of hydrochloric acid, so that they were etched on their surfaces. The drill bit, the reamer, and the drill bit material which were etched were washed with water, and then immersed in an aqueous solution of 25% of nickel nitrate for 30 minutes, and thereafter in a mixed solution of aluminum isopropoxide and titanium isopropoxide. After they were dried, they were fired (heated) in a firing process in which the temperature increased at a rate of 10° C./minute. Specifically, they were maintained at 650° C. for 45 minutes, then maintained at 1250° C. for 15 minutes, 1320° C. for 30 minutes, 1360° C. for 30 minutes, and 1380° C. for 60 minutes. They were fired in vacuum up to 1320° C., and under a pressure of 1 bar in a nitrogen gas beyond 1320° C.

The drill bit, the reamer, and the drill bit material which were thus treated had their surface hardness $H_{RA}$ ranging from 96.8 to 98.4, values which greatly exceeded the surface hardness of a commercially available material of the P type. The drill bit, the reamer, and the drill bit material had coating layers formed on their respective surfaces and having respective thicknesses in the range of from several μm to 12 μm.

Figure 8:
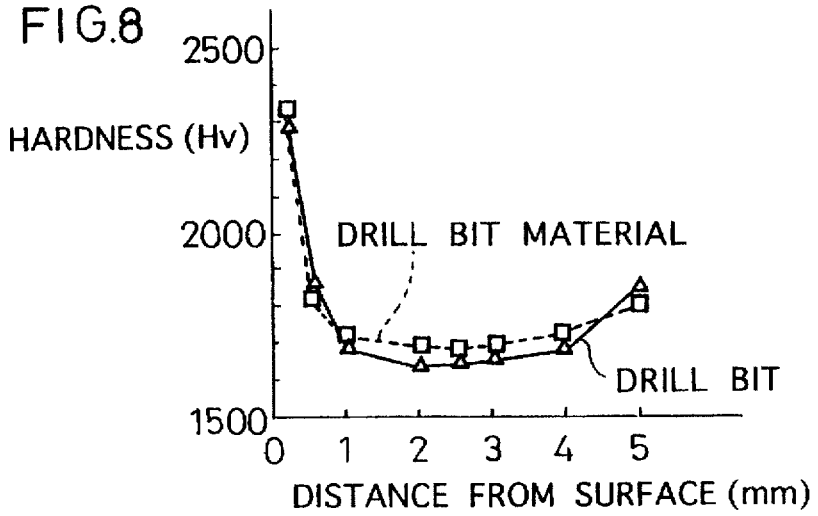
FIG. 8 is a diagram showing the relationship between the distance from the surface and the hardness of a drill bit and a drill bit material.
Figure 9:
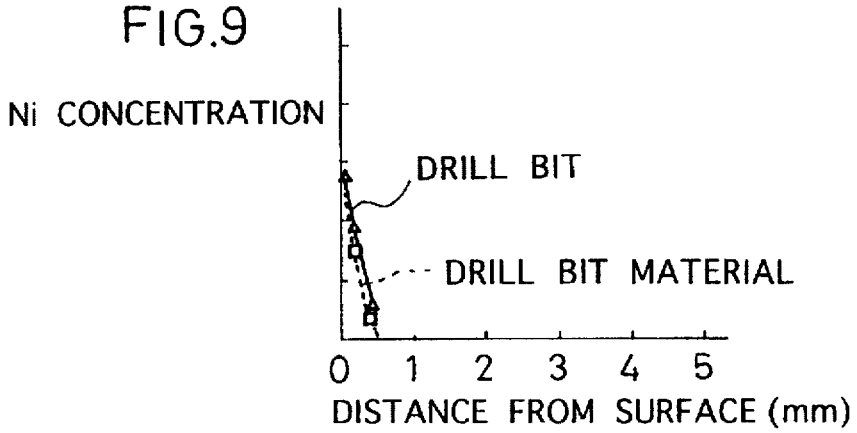
FIG. 9 is a diagram showing the relationship between the distance from the surface and the Ni concentration of the drill bit and the drill bit material.
Figure 10:
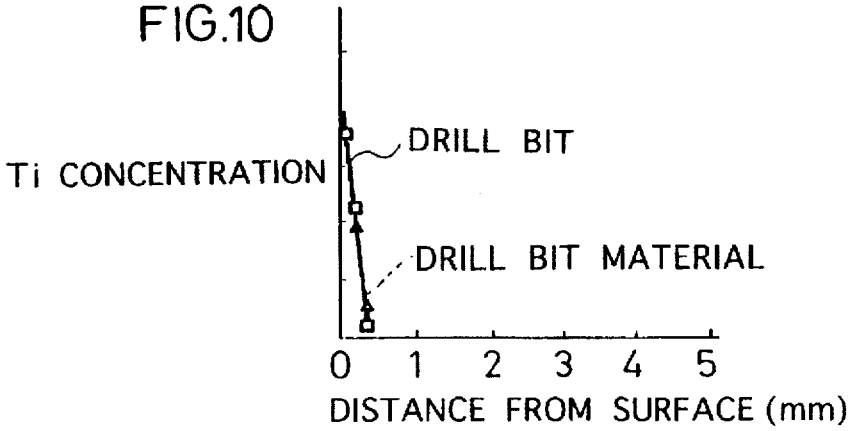
FIG. 10 is a diagram showing the relationship between the distance from the surface and the Ti concentration of the drill bit and the drill bit material.

The drill bit and the drill bit material which were treated were cut in a cross-sectional direction and measured for their properties. As shown in FIG. 8, their hardness varied depending on the distance from their surface. The drill bit and the drill bit material contained Ni and Ti having concentrations shown in FIGS. 9 and 10. Since the drill bit and the reamer were treated in the same manner, the above properties were measured with respect to the drill bit only. It was found out that the drill bit and the drill bit material which were treated had gradient characteristics in a direction inward from their surface.

Figure 11:
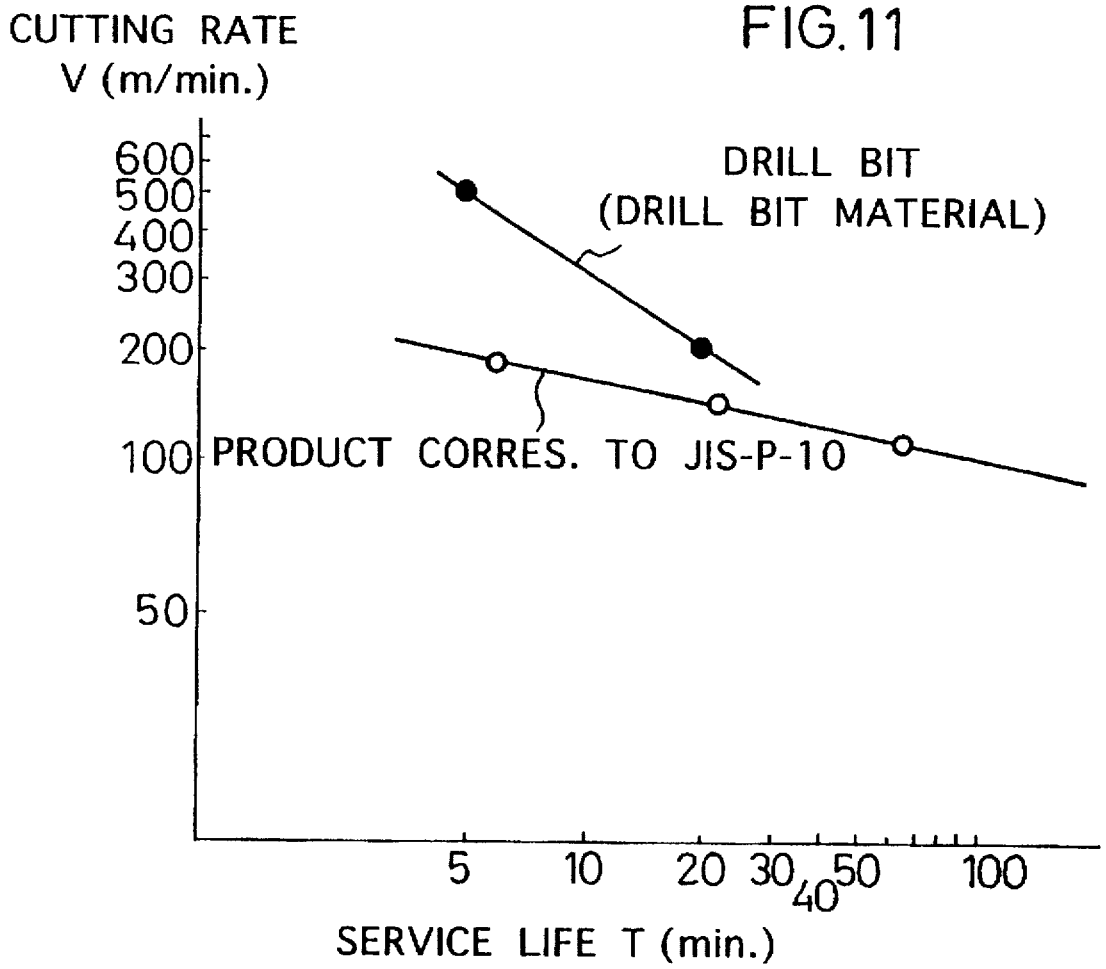
FIG. 11 is a diagram showing the results of life tests on the drill bit, the drill bit material, and another drill bit.
Figure 12:
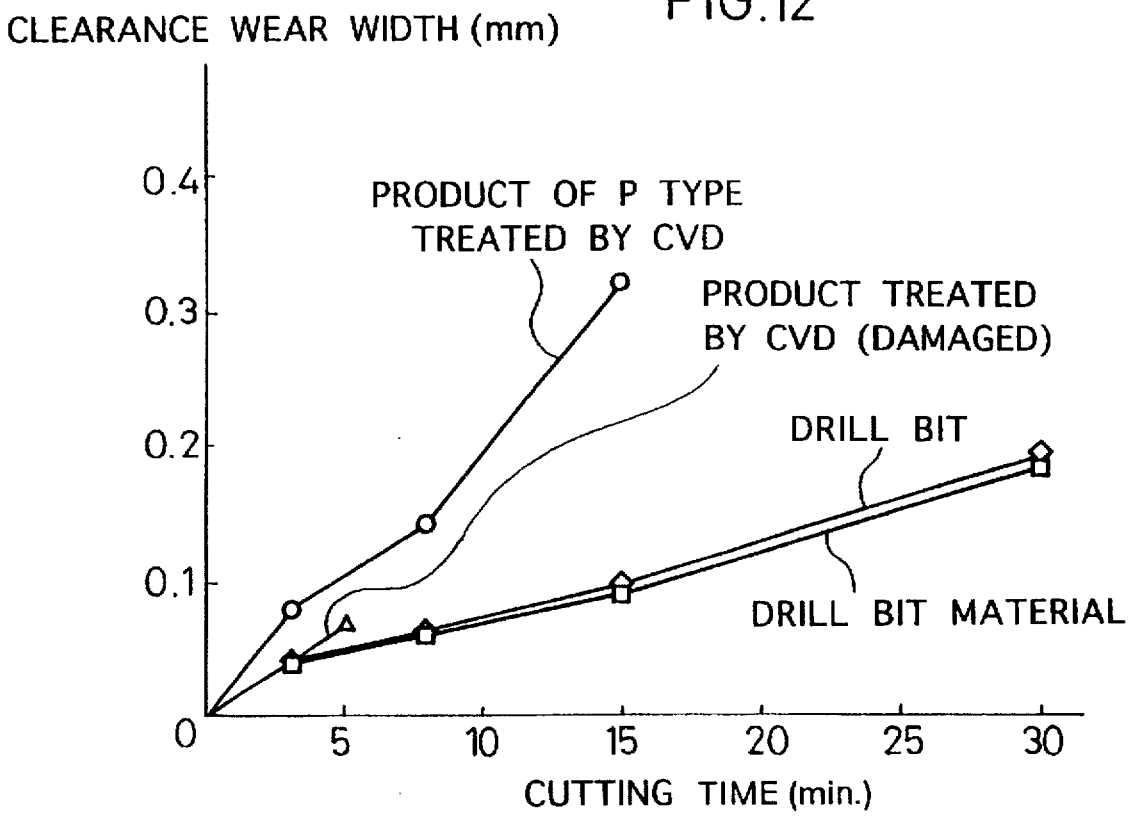
FIG. 12 is a diagram showing the wear resistance of the drill bit, the drill bit material, and other drill bits.

The drill bit and the drill bit material which were treated were measured for service life, and the results are shown in FIG. 11. It can be seen from FIG. 11 that the service life of the drill bit and the drill bit material which were treated was much higher than that of the commercially available product corresponding to the JIS-P-10 material. The drill bit and the drill bit material which were treated, and a conventional product of the P type treated by PVD were tested for wear resistance. The results of the wear-resistance test are shown in FIG. 12. It will be understood from FIG. 12 that the drill bit and the drill bit material which were treated had much better wear resistance than the conventional products processed by PVD, CVD.

The method of case-hardening a shaped object according to the present invention offers the following advantages:

According to the method, a metal salt and/or an organic metal reacts with a shaped object and is diffused into the shaped object, forming a metal-diffused layer due to alloying and microscopic deposition, and converting a surface layer into a ceramic layer by nitriding, carburizing, carbonitriding, or oxidizing. Therefore, the wear resistance, sliding capability, and heat resistance of the surface layer of the shaped object can be increased, and the strength of the internal structure of the shaped object can be increased for preventing the surface layer from peeling off, in a simple and inexpensive process.

Although certain preferred embodiments of the present invention have been shown and described in detail, it should be understood that various changes and modifications may be made therein without departing from the scope of the appended claims.

What is claimed is:

1. A method of case-hardening a shaped object, comprising the steps of:

etching a shaped object to produce a roughened surface on the shaped object;

then, immersing the shaped object in an aqueous solution of a metal salt of at least one of vanadium belonging to the VA group of the periodic table, chromium, molybdenum, and tungsten belonging to the VIA group of the periodic table, manganese belonging to the VIIA group of the periodic table, and nickel and cobalt belonging to the VIII group of the periodic table or at least one of the compounds thereof, or a solution of an organic salt and a metal of at least one of aluminum, yttrium, and lanthanum belonging to the III group of the periodic table, titanium, zirconium, silicon, and hafnium belonging to the IV group of the periodic table, vanadium, tantalum, and niobium belonging to the VA group of the periodic table, and chromium, molybdenum, and tungsten belonging to the VIA group of the periodic table or at least one of the compounds thereof;

drying the shaped object; and thereafter, heating the shaped object to thereby produce a ceramic layer by nitriding, carburizing, carbonitriding or oxidizing on the surface of the shaped object and a metal-diffused layer in the shaped objected formed inwardly of said ceramic layer.

2. A method according to claim 1, wherein said metal salt comprises a nitrate, an acetate, or a chloride.

3. A method according to claim 1, wherein said organic salt comprises an ethoxide, a propoxide, a butoxide, an imide, or an amide.

4. A method of case-hardening a shaped object, comprising the steps of:

etching a shaped object to produce a roughened surface on the shaped object;

then immersing the shaped object in an aqueous solution of a metal salt of at least one of vanadium belonging to the VA group of the periodic table, chromium, molybdenum, and tungsten belonging to the VIA group of the periodic table, manganese belonging to the VIIA group of the periodic table, and nickel and cobalt belonging to the VIII group of the periodic table or at least one of the compounds thereof, and a solution of an organic salt and a metal of at least one of aluminum, yttrium, and lanthanum belonging to the III group of the periodic table, titanium, zirconium, silicon and hafnium belonging to the IV group of the periodic table, vanadium, tantalum, and niobium belonging to the VA group of the periodic table, and chromium, molybdenum and tungsten belonging to the VIA group of the periodic table or at least one of the compounds thereof;

drying the shaped object; and thereafter, heating the shaped object to thereby produce a ceramic layer by nitriding, carburizing, carbonitriding or oxidizing on the surface of the shaped object and a metal-diffused layer in the shaped object formed inwardly of said ceramic layer.

5. A method according to claim 4, wherein said metal salt comprises a nitrate, an acetate, or a chloride.

6. A method according to claim 4, wherein said organic salt comprises an ethoxide, a propoxide, a butoxide, an imide, or an amide.

7. A method of case-hardening a shaped object, comprising the steps of:

cleaning tip of carbide or cermet on a shaped object with an alkaline solution;

etching the tip with acid to produce a roughened surface on the tip;

then, immersing the tip in an aqueous solution of a metal salt of at least one of chromium and tungsten belonging to the VIA group of the periodic table, manganese belonging to the VIIA group of the periodic table, and iron, nickel and cobalt belonging to the VIII group of the periodic table or at least one of the compounds thereof, or a solution of an organic salt and a metal of at least one of aluminum belonging to the III group of the periodic table, titanium and zirconium belonging to the IV group of the periodic table, vanadium belonging to the VA group of the periodic table, and chromium belonging to the VIA group of the periodic table or at least one of the compounds thereof;

drying the shaped object; and thereafter, heating the shaped object to cause a diffusion reaction and thereby produce a ceramic layer by nitriding, carburizing, carbonitriding or oxidizing on the surface of the shaped object and a metal-diffused layer in the shaped object formed inwardly of said ceramic layer.

8. A method according to claim 7, wherein said metal salt comprises a nitrate, an acetate, or a chloride.

9. A method according to claim 7, wherein said organic salt comprises an ethoxide, a propoxide, a butoxide, an imide, or an amide.

10. A method of case-hardening a shaped object, comprising the steps of:

cleaning a tip of carbide or cermet on a shaped object with an alkaline solution;

etching the tip with an acid to produce a roughened surface on the tip;

then, immersing the tip in an aqueous solution of a metal salt of at least one of chromium and tungsten belonging to the VIA group of the periodic table, manganese belonging to the VIIA group of the periodic table, and iron, nickel and cobalt belonging to the VIII group of the periodic table or at least one of the compounds thereof, and a solution of an organic salt and a metal of at least one of aluminum belonging to the III group of the periodic table, titanium and zirconium belonging to the IV group of the periodic table, vanadium belonging to the VA group of the periodic table, and chromium belonging to the VIA group of the periodic table or at least one of the compounds thereof;

drying the shaped object; and thereafter, heating the shaped object to cause a diffusion reaction and thereby produce a ceramic layer by nitriding, carburizing, carbonitriding or oxidizing on the surface of the shaped object and a metal-diffused layer in the shaped object formed inwardly of said ceramic layer.

11. A method according to claim 10, wherein said metal salt comprises a nitrate, an acetate, or a chloride.

12. A method according to claim 10, wherein said organic salt comprises an ethoxide, a propoxide, a butoxide, an imide, or an amide.

* * * * *